US005332132A

United States Patent [19]

Schuske

[11] Patent Number: 5,332,132

[45] Date of Patent: Jul. 26, 1994

[54] MULTI SPOUT BEER VALVE

[76] Inventor: John Schuske, 930 Quinn St., Boulder, Colo. 80303

[21] Appl. No.: 998,365

[22] Filed: Dec. 29, 1992

[51] Int. Cl.[5] ..... B65D 88/54

[52] U.S. Cl. ..... 222/330; 222/400.8; 137/212

[58] Field of Search ..... 222/330, 478, 482, 488, 222/400.8; 137/212

[56] References Cited

U.S. PATENT DOCUMENTS

| | | | |
|---|---|---|---|
| 464,021 | 12/1891 | Hartin | 222/330 |
| 4,350,273 | 9/1982 | Nezworski et al. | 137/212 X |
| 4,516,700 | 5/1985 | Guzowski | 222/330 |
| 4,728,010 | 3/1988 | Johnston | 222/400.8 X |

*Primary Examiner*—Gregory L. Huson
*Attorney, Agent, or Firm*—Ralph M. Martin

[57] ABSTRACT

A conventional manual pump beer keg dispensing assembly is improved by widening the exit tube and adding a plurality of spouts. A keg of beer can thereby be emptied in half the time while serving three patrons at once.

2 Claims, 5 Drawing Sheets

MULTI SPOUT BEER VALVE

FIELD OF THE INVENTION

The present invention relates to improving a conventional beer keg valve by adding spouts and doubling the flow rate.

BACKGROUND OF THE INVENTION

Conventional beer party kegs are pressurized by a manual hand pump mounted atop the keg dispensing valve. The manual hand pump is used to maintain about 18 p.s.i. pressure inside a keg which usually holds about 15.5 gallons of beer. A single pouring spout allows beer to flow out of the keg.

During operation at a party the limitation of a single pouring spout often causes a waiting line by the keg.

The present invention doubles the flow rate out of the keg while simultaneously maintaining a good flowing beer without excess foam. The preferred embodiment has three pouring spouts instead of only one. Also the diameter of the exit draft tube in the dispensing valve has been widened to at least 7 mm.

SUMMARY OF THE INVENTION

The main object of the present invention is to double the flow rate out of a conventional beer keg by using multiple spouts.

Another object of the present invention is to widen the exit draft tube in the dispensing valve, thereby allowing a standard air pump to maintain a foam free flow of beer through multiple pouring spouts.

Other objects of this invention will appear from the following description and appended claims, reference being had to the accompanying drawings forming a part of this specification wherein like reference characters designate corresponding parts in the several views.

A conventional single spouted manual pump beer dispensing valve is improved by adding two more pouring spouts. The length of the flexible spout tubes are the same as the original in order to maintain adequate pressure in the keg during pouring. The diameter of the exit draft tube is enlarged to at least 7 millimeters.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENT

Figure 1:
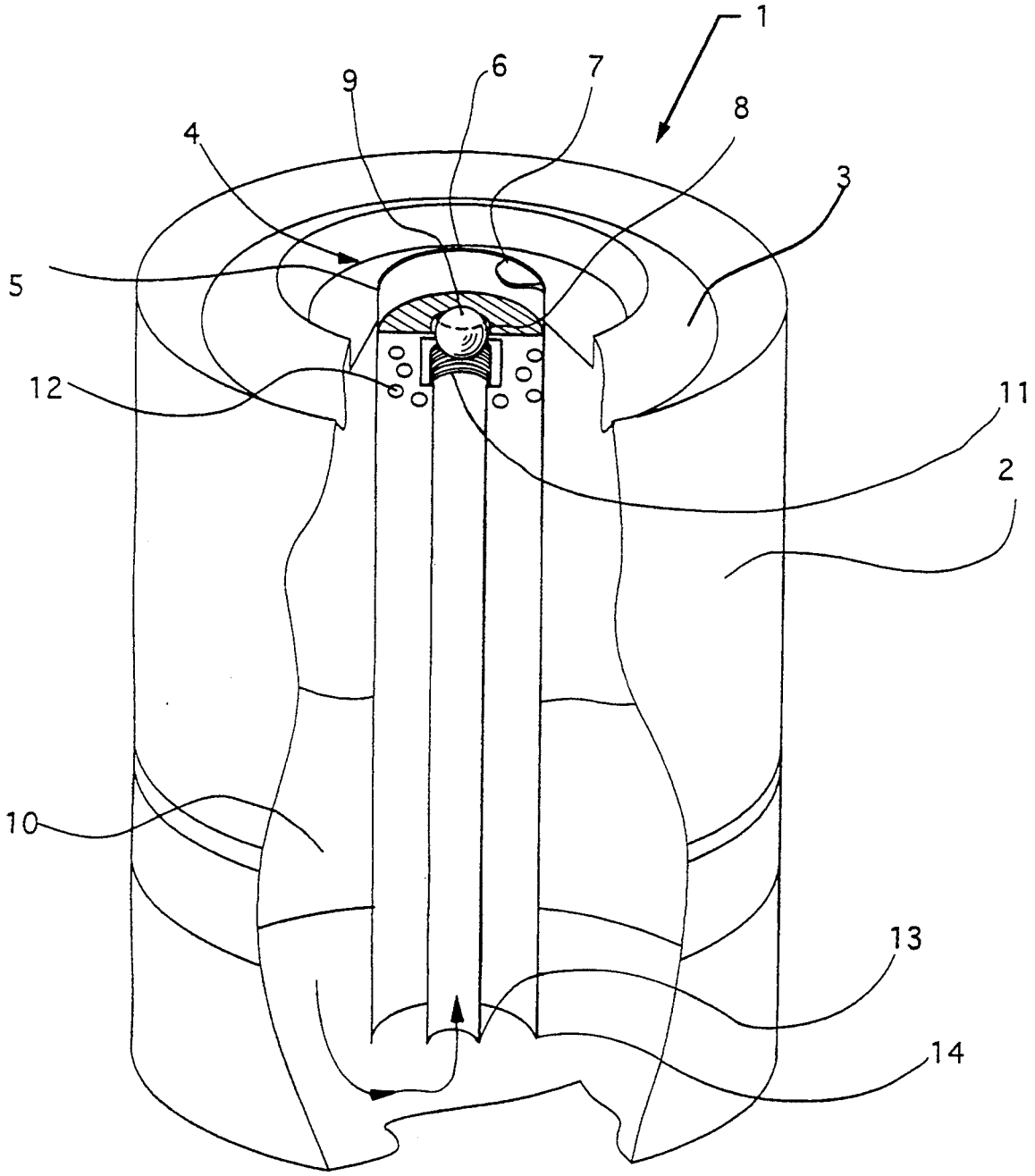
FIG. 1 (Prior Art)
FIG. 1 is a top perspective view of a beer keg with a partial cutaway showing the exit tube.
Figure 2:
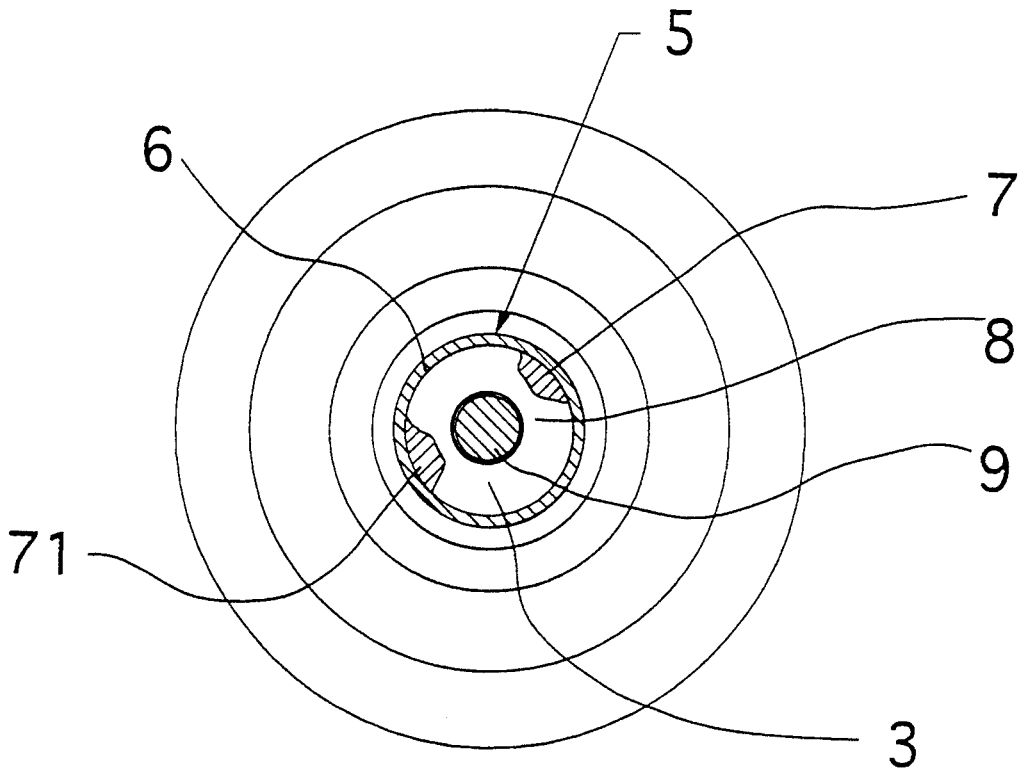
FIG. 2 (Prior Art)
FIG. 2 is a top plan view of the beer keg of FIG. 1.

Referring first to FIG. 1 a beer keg 1 has a sidewall 2, a top 3 and a conventional tap assembly 4. The tap assembly 4 comprises a neck 5 with a top flange 6. Mounting lugs 7, 71 (see FIG. 2) extend into the core of the neck 5. A rubber gasket 8 seals the plunger ball 9 against the top 3.

Inside the keg 1 is beer 10. A tap tube 13 is housed in a pipe 14. Pipe 14 has gas holes 12 to enable a pressurizing gas to be injected past plunger ball 9 and into the keg 1. A spring 11 pushes plunger ball 9 against rubber gasket 8 thereby sealing shut keg 1.

Figure 3:
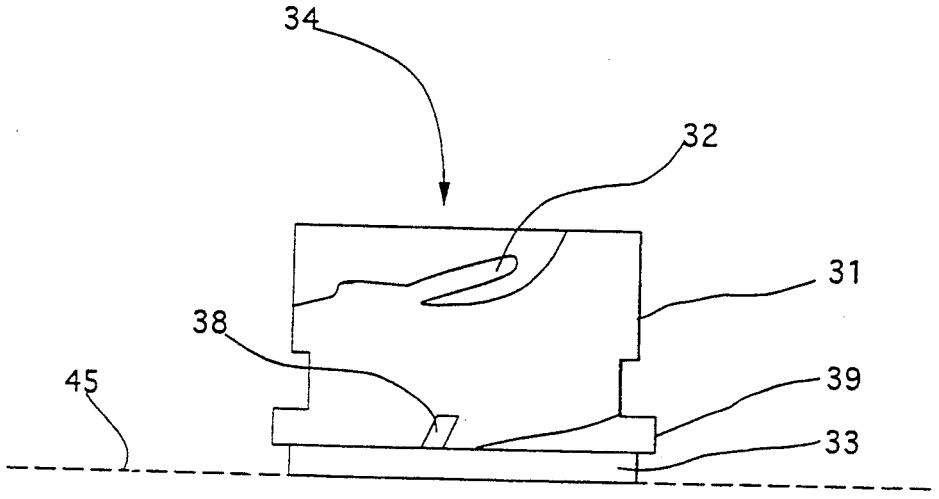
FIG. 3 (Prior Art)
FIG. 3 is a side plan view of a locking collar suited for engaging in the top of the beer keg of FIGS. 1, 2.

Referring next to FIG. 3 a keg coupler 30 is designed to be removably clamped inside neck 5 by means of barrel 31 which has a cam 39, stop 38 and groove 32. Rubber sealing gasket 33 seals against top 3 when the keg coupler 30 is clamped inside neck 5. Line 45 indicates the top of keg 1.

Figure 4:
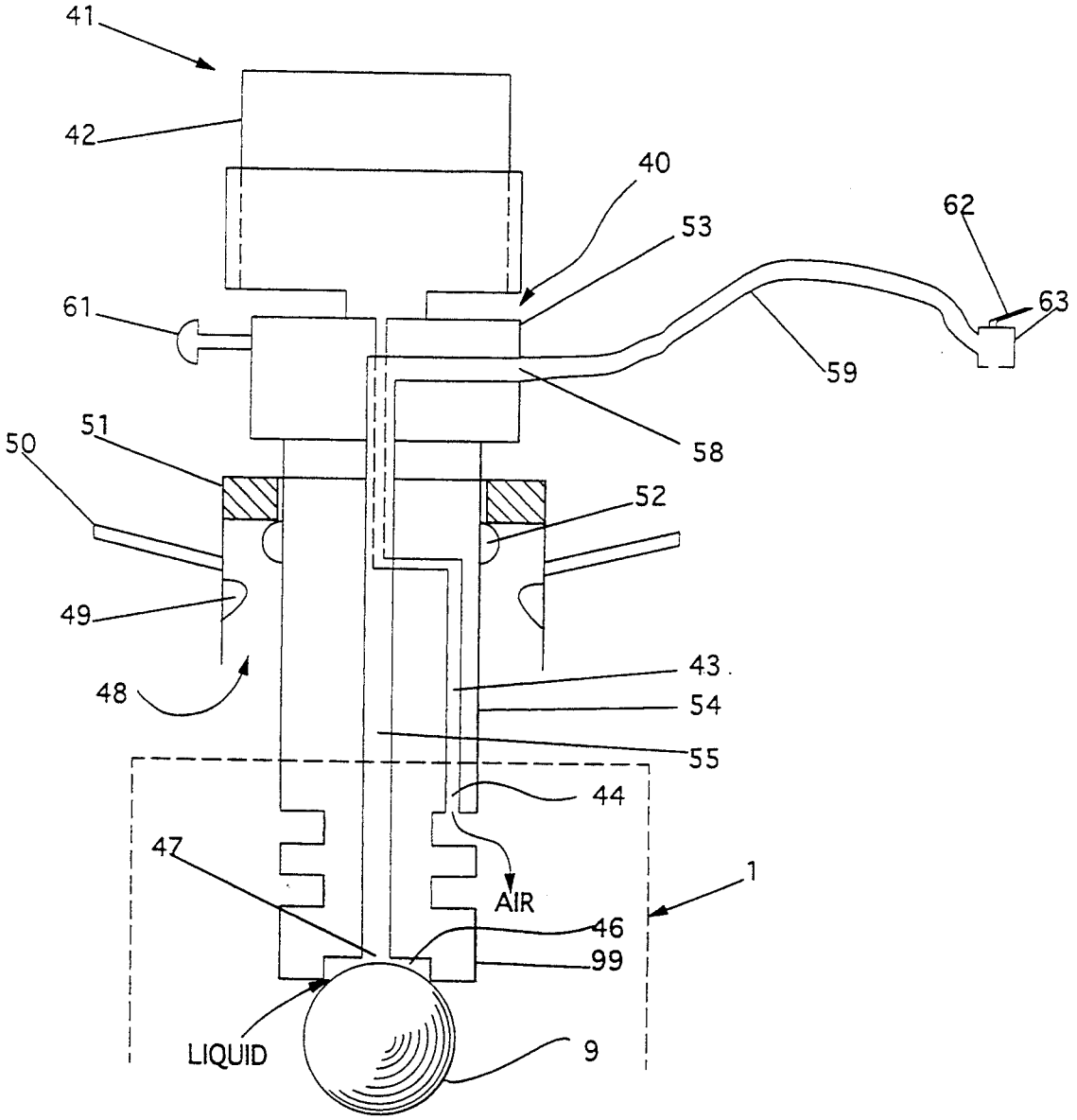
FIG. 4 (Prior Art)
FIG. 4 is a side plan view with a partial cutaway of a dispensing assembly suited for engaging in the locking collar of FIG. 3.

Referring next to FIG. 4 an extraction assembly 40 is designed to fit inside the keg coupler 30 of FIG. 3 as indicated by arrow 34. A handle 50 surrounds the keg coupler 30 which fits in space 48. Handle 50 engages the groove 32 by means of handle lugs 49. A mounting rim 52 on shaft 54 supports handle 50 on brace 51. Turning handle 50 forces keg coupler 30 into the mounted position on keg 1. Thus the tip 99 of shaft 54 is forced against plunger ball 9 thereby opening keg 1.

A hand pump 41 has a plunger 42. The hand pump 41 is mounted on tap head 53. Gas line 43 extends down shaft 54 and exits into keg 1 through hole 44 which is located below line 45. A pressure release valve 61 allows de-pressurizing the keg 1.

In operation air is pumped into the keg 1 through hole 44. The pressure drives the beer 10 of FIG. 1 up the tap tube 13, around the plunger ball 9, into the slot 46 of FIG. 4, into the hole 47, and up the exit tube 55.

An exit fitting 58 allows connection of flexible hose 59 which has a manual assembly 600. Manual valve assembly 600 comprises a spout 63, and a manual valve actuator 62.

The traditional tap head 53 has only one exit fitting 58 which permits about 400 milliliters per 13 seconds of beer to flow up exit tube 55 having a nominal diameter of 5–7 millimeters.

Other embodiments (not shown) of the manual pump keg dispensing apparatus described above include a Bronco Pump TM which uses a lever type locking mechanism in place of handle 50. The lever type locking mechanism uses the shaft as a fulcrum. A plastic tap head is molded as part of the manual pump. A single exit fitting extends from the tap head. The diameter of the exit tube is 7 millimeters. The flow rate of this embodiment is approximately 325 milliliters per 13 seconds.

Figure 5:
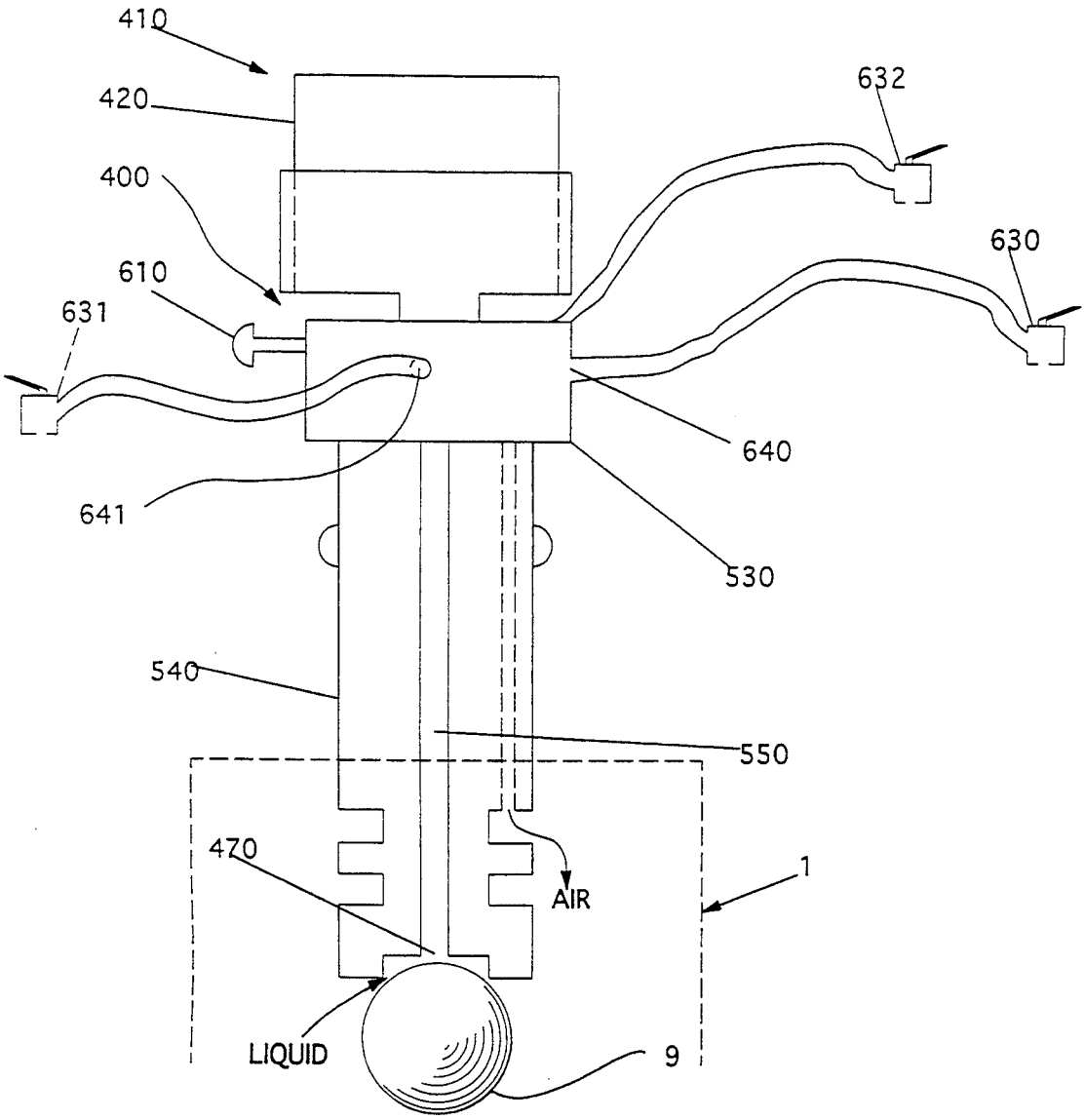
FIG. 5 is a side plan view with a partial cutaway of the improved dispensing assembly having three dispensing spouts.
Figure 6:
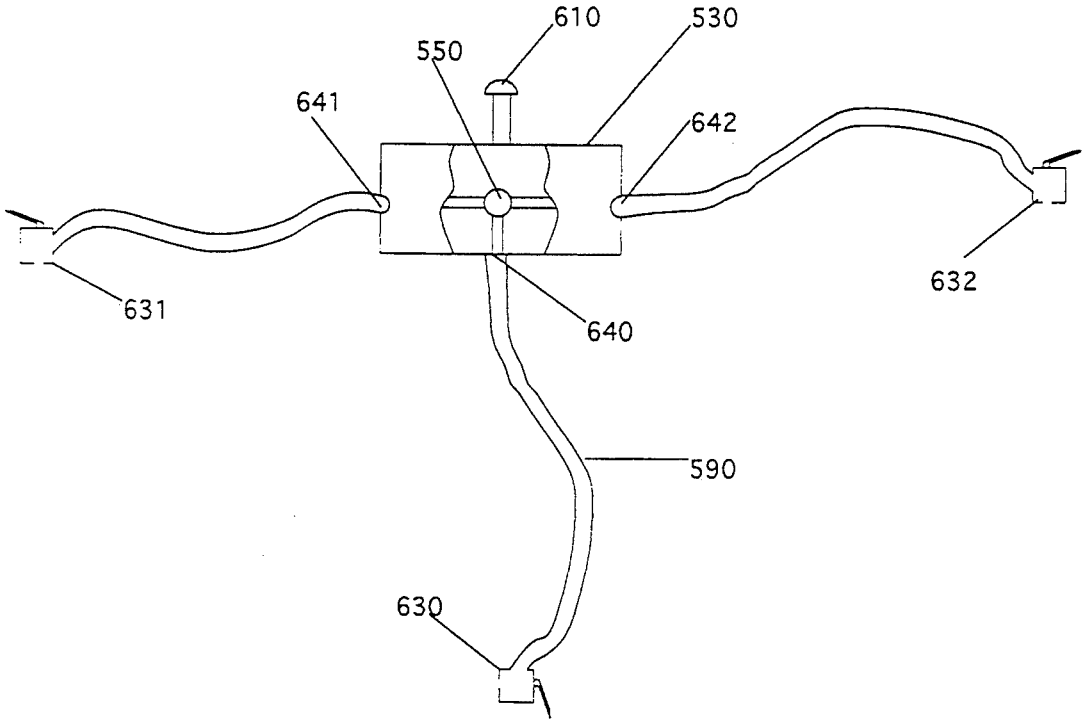
FIG. 6 is a top plan view of the improved dispensing assembly shown in FIG. 5.

Referring next to FIGS. 5, 6 the improvement to the prior art shown in FIG. 4 is disclosed as the Thirsty Tap TM 400. The shaft 540 has a 7 millimeter or wider exit tube 550 and hole 470. The tap head 530 further comprises exit fittings 640, 641, 642 each having an equal length flexible hose 590 with manual valve assemblies 630, 631, 632. An equal orifice flow splitter 550 supplies equal amounts of beer to exit fittings 640, 641, 642. A standard pressure release valve 610 is included. The same pump 410 is included having a plunger 420.

The above improvements can be incorporated into the Bronco Pump TM by changing the single exit fitting to a triple (or more) exit fitting as part of the molded plastic tap head.

Although the present invention has been described with reference to preferred embodiments, numerous modifications and variations can be made and still the result will come within the scope of the invention. No limitation with respect to the specific embodiments disclosed herein is intended or should be inferred.

I claim:

1. An improvement to a keg dispensing apparatus having a keg, a tap tube extending therein, a spring loaded plunger ball releasably sealing the top of the tap tube, a coupling neck atop the plunger ball, a keg coupler releasably mounted inside the coupling neck, the improvement comprising:

a self contained portable dispensing apparatus which includes;

a shaft slidingly engaged inside the keg coupler;

said shaft further comprising an exit tube having a diameter of approximately or greater than 7 mm, a gas inlet tube, a tip to release the plunger ball, and means to lock the keg coupler to the coupling neck;

a tap head affixed to the shaft;

said tap head further comprising means for supplying gas pressure to said gas inlet tube, and multiple exit fittings to provide for fluid flow from the keg and up the exit tube and said means for supplying gas pressure to said gas inlet tube further comprising a manual air pump affixed to said tap head.

2. A keg dispensing apparatus comprising:

a self contained portable dispensing apparatus which includes;

a keg coupler that can be releasably sealed to a tap assembly of a beer keg;

said keg coupler having means for locking to said tap assembly of said beer keg;

a shaft coaxial with and extending into a collar member;

said shaft further comprising a passage for beer, an opening at a lower end of said shaft, and an equal orifice flow splitter at an upper end of said shaft;

said equal orifice flow splitter being connected to more than one hose for dispensing beer;

said passage for beer having a diameter of approximately or greater than 7 millimeters;

said shaft further comprising a tip to open a plunger ball in said tap assembly of said beer keg;

said tip further comprising slotted cutouts to allow beer to flow around said plunger ball and up said passage for beer;

said shaft further comprising a gas passage wherein a pressurizing gas can be injected past said plunger ball and into said beer keg;

said gas passage being connected at the upper end to means for injection a pressurizing gas and said means for injecting a pressurizing gas further comprising a hand operated air pump as an integral part of said portable dispensing apparatus.

* * * * *